US008998683B2

(12) United States Patent
Zeng et al.

(10) Patent No.: US 8,998,683 B2
(45) Date of Patent: Apr. 7, 2015

(54) POLISHING DEVICE WITH DRIVING MECHANISMS

(75) Inventors: Xian-Cai Zeng, Shenzhen (CN); Dong-Cheng Liu, Shenzhen (CN); Chin-Tsan Huang, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 404 days.

(21) Appl. No.: 13/484,635

(22) Filed: May 31, 2012

(65) Prior Publication Data

US 2013/0078894 A1 Mar. 28, 2013

(30) Foreign Application Priority Data

Sep. 22, 2011 (CN) ..... 2011 1 0283683

(51) Int. Cl.

| | |
|---|---|
| ***B24B 21/22*** | (2006.01) |
| ***B24B 21/00*** | (2006.01) |
| ***B24B 21/20*** | (2006.01) |
| ***B24B 21/08*** | (2006.01) |
| ***B24B 47/12*** | (2006.01) |

(52) U.S. Cl.

CPC ..... *B24B 21/00* (2013.01); *B24B 21/20* (2013.01); *B24B 21/08* (2013.01); *B24B 47/12* (2013.01)

(58) Field of Classification Search

CPC ..... B24B 21/002; B24B 21/04; B24B 21/08; B24B 21/20; B24B 23/06

USPC ..... 451/303, 311, 340, 355, 363, 513

See application file for complete search history.

(56) References Cited

U.S. PATENT DOCUMENTS

2009/0029629 A1* 1/2009 Shin et al. ..... 451/5

FOREIGN PATENT DOCUMENTS

| | | |
|---|---|---|
| EP | 2138256 B1 | 6/2011 |
| JP | 2002519129 A | 7/2002 |

* cited by examiner

*Primary Examiner* — Timothy V Eley

(74) *Attorney, Agent, or Firm* — Novak Druce Connolly Bove + Quigg LLP

(57) ABSTRACT

A polishing device includes a reducer, a polishing mechanism, a rotatably driven mechanism, and a sliding driving mechanism. The polishing mechanism is connected to the reducer. The rotatably driven mechanism includes a first driving member and a transmission shaft, the first driving member includes a first main body and an output shaft rotatably connected to first main body, the transmission shaft is fixed to the output shaft. A sliding driving mechanism includes a second driving member, the second driving member includes a second main body and a driving shaft collar connected to the second main body, the second main body is fixed to the first main body. The second main body and driving shaft collar cooperatively define a through hole. The transmission shaft extends through the through hole and is connected to the reducer to enable the polishing mechanism to polish a workpiece. The driving shaft is fixed to the reducer.

19 Claims, 3 Drawing Sheets

POLISHING DEVICE WITH DRIVING MECHANISMS

BACKGROUND

1. Technical Field

The present disclosure relates to polishing devices, and particularly to a polishing device for polishing a periphery of a workpiece.

2. Description of Related Art

Polishing devices include a rotatably driven mechanism, a sliding driving mechanism and a polishing mechanism. The rotatably driven mechanism polishes an outer surface of a workpiece via the polishing mechanism. The sliding driving mechanism drives the rotatably driven mechanism to move along a periphery of the workpiece to polish the workpiece automatically. The rotatably driven mechanism includes a plurality of cables. When the rotatably driven mechanism moves along the periphery of the workpiece, the cables may easily wind around an outer surface of a driving shaft of the sliding driving mechanism, thus the cables may be damaged, and suspends the polishing work.

Therefore, there is room for improvement in the art.

BRIEF DESCRIPTION OF THE DRAWINGS

The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
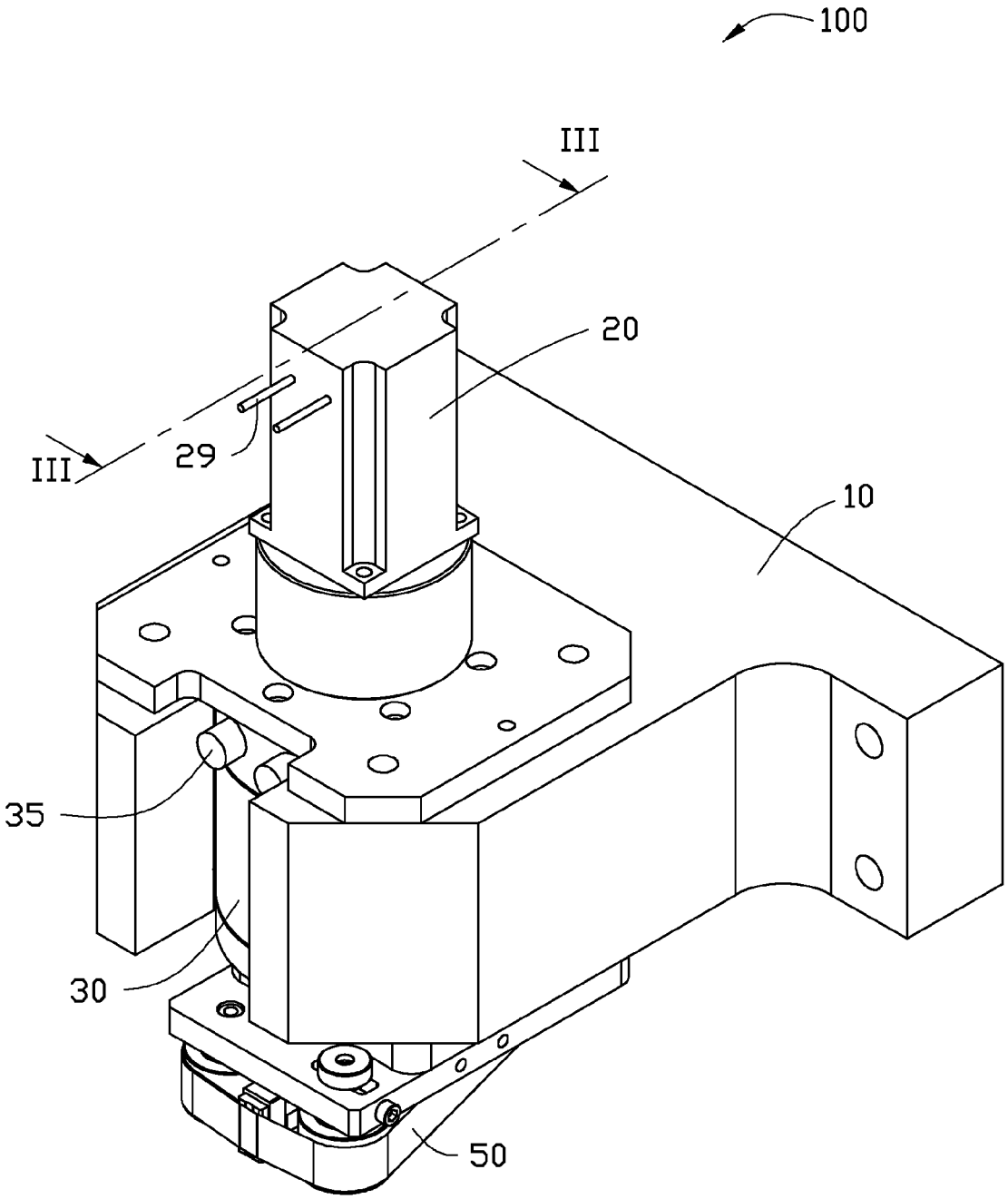
FIG. 1 is an isometric, assembled view of an embodiment of a polishing device.
Figure 2:
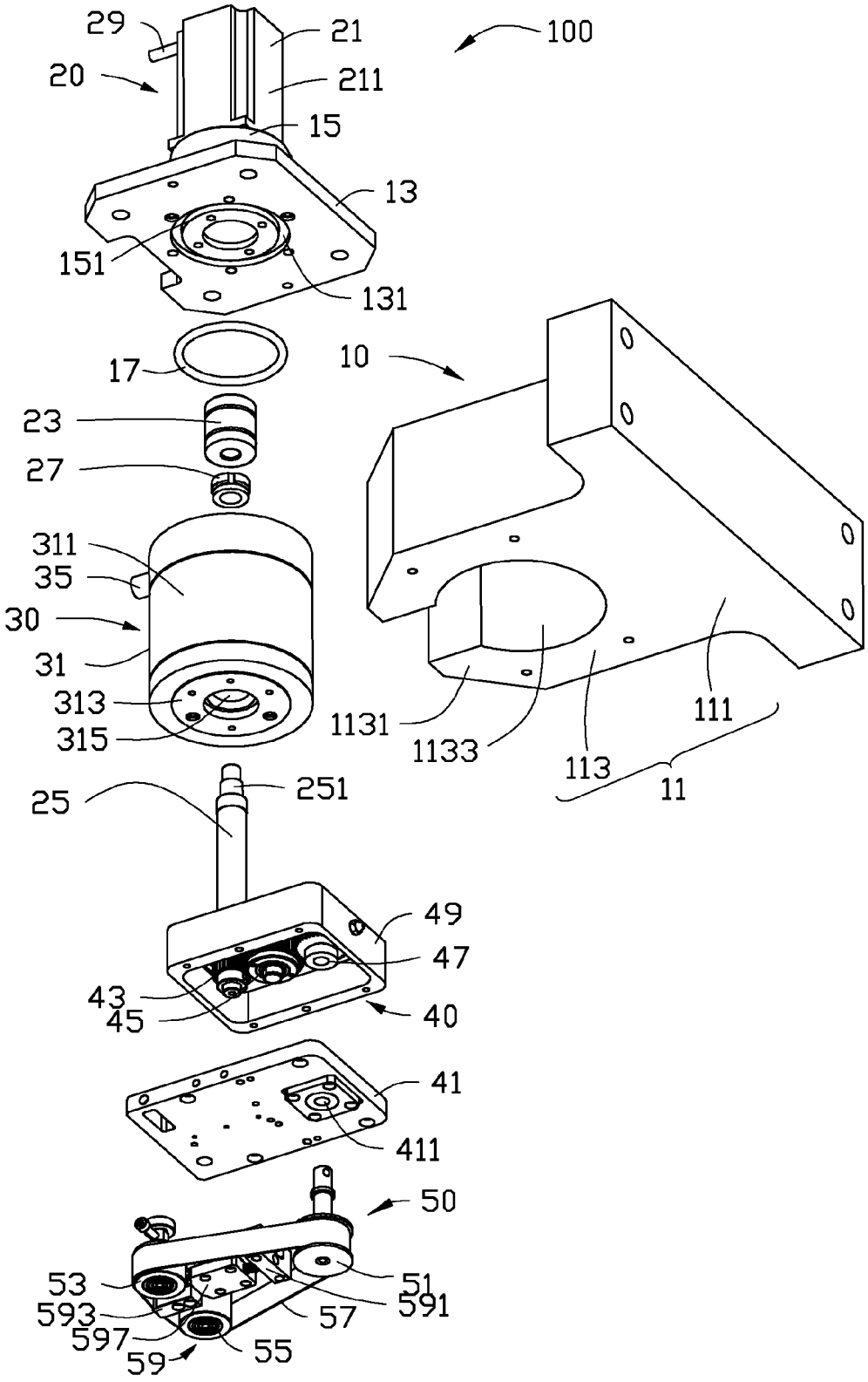
FIG. 2 is an isometric, exploded view of the polishing device of FIG. 1.

Referring to FIGS. 1 and 2, an embodiment of a polishing device 100 includes a fixing mechanism 10, a rotatably driven mechanism 20, a sliding driving mechanism 30, a reducer 40, and a polishing mechanism 50. The rotatably driven mechanism 20 is fixed to the fixing mechanism 10. The sliding driving mechanism 30 is connected to the rotatably driven mechanism 20. The reducer 40 and the polishing mechanism 50 are connected to the sliding driving mechanism 30 in turn.

The fixing mechanism 10 includes a fixing seat 11, a fixing plate 13, a mounting seat 15, and a sealing washer 17.

The fixing seat 11 includes a base body 111 and a clamping portion 113 extending from a middle portion of the base body 111. The clamping portion 113 includes a pair of clamping cantilevers 1131 and defines a mounting space 1133 between the pair of clamping cantilevers 1131. The fixing plate 13 is fixed to the clamping portion 113 and defines a through hole 131 thereon communicating with the mounting space 1133. The mounting seat 15 is a substantially cylindrical shell, and is mounted on the fixing plate 13. The mounting seat 15 includes an annular stepped portion 151 at an end thereof. The stepped portion 151 is received in the through hole 131. The sealing washer 17 is sleeved on the stepped portion 151.

Figure 3:
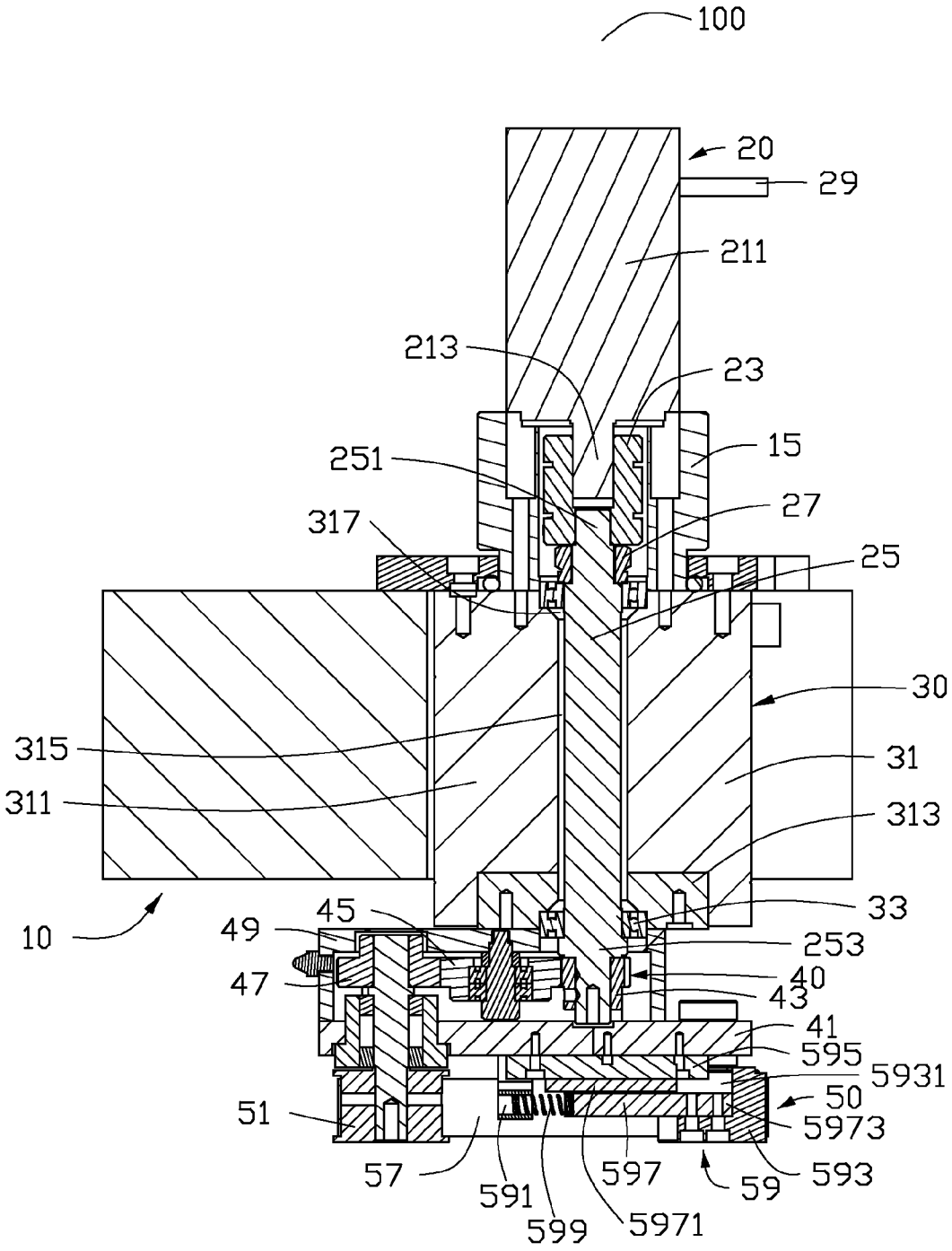
FIG. 3 is a cross-sectional view of the polishing device of FIG. 1, taken along line III-III.

Also referring to FIG. 3, the rotatably driven mechanism 20 includes a first driving member 21, a transmission member 23, a transmission shaft 25, a sleeve 27, and a first cable 29. The first driving member 21 includes a first main body 211 and an output shaft 213 rotatably connected to the first main body 211. The first main body 211 is fixed to the mounting seat 15, and the output shaft 213 is received in the mounting seat 15. The transmission shaft 25 is substantially cylindrical and includes a pair of shaft ends 251 at opposite ends thereof. The transmission shaft 25 further includes an annular resist portion 253 on one shaft end 251. The transmission shaft 25 is connected to the reducer 40 by the shaft end 251 that has the resist portion 253. The transmission member 23 is sleeved on the other shaft end 251 of the transmission shaft 25 and a portion of the output shaft 213 to connect or couple the transmission shaft 25 to the output shaft 213. The sleeve 27 is substantially annular and sleeved on the shaft end 251 adjacent to the transmission member 23. The first cable 29 is connected to the first main body 211 of the first driving member 21. In the present embodiment, the transmission member 23 is a shaft coupling.

The sliding driving mechanism 30 includes a second driving member 31, a pair of bearings 33, and a second cable 35. The second driving member 31 is received in the mounting space 1133 and located between the pair of clamping cantilevers 1131. The second driving member 31 includes a second main body 311 fixed to the fixing seat 11 and a driving shaft collar 313 rotatably connected to the second main body 311. The second main body 311 and the driving shaft collar 313 cooperatively define a through hole 315 in the middle of the second driving member 31. The second main body 311 and the driving shaft collar 313 cooperatively define a pair of receiving portions 317 away from each other.

The transmission shaft 25 of the rotatably driven mechanism 20 extends through the through hole 315. The pair of shaft ends 251 extends out of the receiving portions 317, respectively. The pair of bearings 33 are sleeved on the pair of shaft ends 251 of the transmission shaft 25 respectively, and received in the pair of receiving portions 317. One bearing 33 resists the sleeve 27, and the other bearing 33 resists the resist portion 253 of the transmission shaft 25 from an inner side of the resist portion 253. The second cable 35 is connected to the second main body 311. In the illustration embodiment, the bearings 33 are a plurality of deep groove ball bearings.

The reducer 40 includes a mounting plate 41, a driving gear 43, a first gear 45, a second gear 47, and a shield cover 49. The mounting plate 41 is a substantially rectangular plate and defines a mounting hole 411 for receiving the second gear 47. The driving gear 43 extends through the shield cover 49 and is sleeved on an end of the transmission shaft 25. The first gear 45 and the second gear 47 are mounted on the mounting plate 41. The driving gear 43 and the second gear 47 are located at opposite sides of the first gear 45, and engage with the first gear 45, respectively. The driving gear 43, the first gear 45, and the second gear 47 are capable of rotating around themselves and the number of gears between them are different. The second gear 47 is partially received in the mounting hole 411 of the mounting plate 41. The shield cover 49 defines an opening (not labeled) at an end thereof for receiving the driving gear 43, the first gear 45, and the second gear 47; the mounting plate 41 seals the opening of the shield cover 49. In the embodiment, the driving gear 43, the first gear 45, and the second gear 47 are arranged in a line on the mounting pate 41.

The polishing mechanism 50 is mounted on the mounting plate 41 opposite to the shield cover 49. The polishing mechanism 50 includes a driving pulley 51, a tension pulley 53, a transmission pulley 55, a polishing belt 57, and a push assembly 59. The driving pulley 51, the tension pulley 53, and the transmission pulley 55 are mounted on the mounting plate 41 and form a triangle. The polishing belt 57 is sleeved on the peripheries of the driving pulley 51, the tension pulley 53, and the transmission pulley 55. The push assembly 59 is located between the tension pulley 53 and the transmission pulley 55, and elastically pushes the polishing belt 57 outwardly.

The driving pulley 51 is fixed to the second gear 47 adjacent to the mounting hole 411. The tension pulley 53 and the transmission pulley 55 are mounted on the mounting plate 41, and rotatable around themselves. The polishing belt 57 is capable of moving around the peripheries of the driving pulley 51, the tension pulley 53, and the transmission pulley 55. The push assembly 59 includes a fixing member 591, a pushing member 593, a guiding rail 595, a connecting member 597, and an elastic member 599. The fixing member 591 is fixed to the mounting plate 41. The pushing member 593 is a block having an "L" shape and is located away from the fixing member 591. A first end of the pushing member 593 resists the polishing belt 57, and a second end of the pushing member 593 opposite to the first end thereof defines a pushing space 5931 together with the mounting plate 41. The guiding rail 595 is mounted on the mounting plate 41, an end of the guiding rail 595 is connected to the fixing member 591, and an opposite end of the guiding rail 595 is received in the pushing space 5931. The connecting member 597 is slidably mounted on the guiding rail 595 and includes a pair of plates (not labeled) laminated together. The pair of plates is overlapped in the middle portion and protrudes toward opposite ends relative to each other, thus forming an extending end 5971 and a pushing end 5973 at opposite ends thereof. The pushing end 5973 is connected to the pushing member 593. The elastic member 599 is contained between the fixing member 591 and the extending end 5971 of the connecting member 597.

In assembly, the fixing seat 11, the fixing plate 13 and the mounting seat 15 are mounted in turn. The sealing washer 17 is sleeved on the mounting seat 15. The first driving member 21 is fixed to the mounting seat 15. The transmission member 23 is sleeved on the output shaft 213 of the first driving member 21, a portion of the transmission member 23 and the sleeve 27 are sleeved on the transmission shaft 25. The transmission shaft 25 extends through the through hole 315. The second driving member 31 is mounted on the fixing seat 11 and received within the receiving space 1133.

The shield cover 49 is connected to the driving shaft collar 313 of the second driving member 31. The driving gear 43, the first gear 45, and the second gear 47 are mounted on the mounting plate 41, and received between the mounting plate 41 and shield cover 49. The driving gear 43 and the second gear 47 engage with the opposite sides of the first gear 75. The driving gear 43 is fixed to the transmission shaft 25 and received in the through hole 315.

The driving pulley 51 is fixed to the second gear 47. The driving pulley 51, the tension pulley 53 and the transmission pulley 55 are mounted on the mounting plate 41 and sleeved by the polishing belt 57. The fixing member 591 and the guiding rail 595 are mounted on the mounting plate 41. The connecting member 597 is slidably mounted on the guiding rail 595. The elastic member 599 is compressed between the connecting member 597 and the fixing member 591. The pushing member 593 is mounted on the pushing end 5973 of the connecting member 597, such that the pushing member 593 pushes the polishing belt 57 outwardly to complete the assembling of the polishing device 100.

When in use, the output shaft 213 of the first driving member 21 is rotated in the through hole 315. The driving gear 43 is rotated via the transmission member 23 and the transmission shaft 25. The driving gear 43 drives the driving pulley 51 to rotate, and then the polishing belt 57 rotates. The pushing member 593 pushes the polishing belt 57 outward to abut a workpiece, so that the workpiece is polished by the polishing belt 57. The driving shaft collar 313 of the second driving member 31 is rotated and drives the shield cover 49 to rotate, so that the reducer 40 and the polishing mechanism 50 rotate completely to drive the polishing belt 57 to move along the workpiece, and thus the automatically polishing of the polishing device 100 is completed.

The transmission shaft 25 of the rotatably driven mechanism 20 is capable of inserting through the second driving member 31 to drive the polishing belt 57 to move along the periphery of a workpiece, due to the through hole 315 defined on the second main body 311 and the driving shaft collar 313 of the second driving member 31. The first main body 211 of the rotatably driven mechanism 20 and the first cable 29 remain static or stationary when the polishing device 100 is operating, thus the first cable 29 is prevented from surrounding around the second driving member 31. The power and torsion of the first driving member 21 is transmitted to the reducer 40 via the transmission member 23 and the transmission shaft 25, so that the output of the power and torsion of the polishing device 100 is more evenly distributed.

It should be noted that when the reducing ratio of the driving gear 43 and the second gear 47 satisfies the demands of the polishing device 100, in which the first gear 45 may be omitted and the driving gear 43 engages with the second gear 47 directly.

There may be a plurality of bearings 33 sleeved on the transmission shaft 25 and received in the through hole 315.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A polishing device, comprising:

a reducer;

a polishing mechanism connected to the reducer;

a rotatably driven mechanism comprising a first driving member and a transmission shaft, wherein the first driving member comprises a first main body and an output shaft rotatably connected to the first main body, the transmission shaft is fixed to the output shaft; and a sliding driving mechanism comprising a second driving member, wherein the second driving member comprises a second main body and a driving shaft collar rotatably connected to the second main body, the second main body is fixed to the first main body, the second main body and the driving shaft collar cooperatively define a through hole through which the transmission shaft extends and is connected to the reducer to enable the polishing mechanism to polish a workpiece, the driving shaft collar is fixed to the reducer to enable the reducer and the polishing mechanism to rotate completely along a periphery of the workpiece and polish the workpiece automatically.

2. The polishing device of claim 1, wherein the rotatably driven mechanism further comprises a transmission member, the transmission member is sleeved on the transmission shaft and the output shaft of the first driving member to connect the transmission shaft to the output shaft.

3. The polishing device of claim 2, wherein the second main body and the driving shaft collar further define a pair of receiving portions at opposite ends of the through hole, the sliding driving mechanism further comprises a pair of bearings, the pair of bearings is sleeved on opposite ends of the transmission shaft and received in the pair of receiving portions, respectively.

4. The polishing device of claim 3, wherein the transmission shaft comprises a pair of shaft ends at opposite ends thereof, the pair of shaft ends are connected to the reducer and the transmission member respectively, the transmission shaft further comprises a resist portion on the shaft end adjacent to the reducer, and one of the pair of bearings resists the resist portion from an inner side of the transmission shaft.

5. The polishing device of claim 4, wherein the rotatably driven mechanism further comprises a first cable connected to the first main body, and the sliding driving mechanism further comprises a second cable connected to the second main body.

6. The polishing device of claim 1, further comprising a fixing mechanism, wherein the fixing mechanism comprises a fixing seat, a fixing plate and a mounting seat, the fixing plate is fixed to the fixing seat and defines a through hole thereon, the mounting seat is partially received in the through hole of the fixing plate, and the first main body is fixed to the mounting seat.

7. The polishing device of claim 6, wherein the fixing seat comprises a base body and a clamping portion extending from a middle portion of the base body, the clamping portion comprises a pair of clamping cantilevers and defines a mounting space between the pair of clamping cantilevers, the second driving member is received in the mounting space and located between the pair of clamping cantilevers.

8. The polishing device of claim 6, wherein the polishing mechanism comprises a driving pulley, a tension pulley, a transmission pulley, a polishing belt and a push assembly, the driving pulley is connected to the transmission shaft via the reducer, the polishing belt is sleeved on a periphery of the driving pulley, the tension pulley and the transmission pulley, the push assembly is capable of pushing the polishing belt outward to polish a workpiece.

9. The polishing device of claim 8, wherein the push assembly comprises a fixing member, a pushing member and an elastic member, the fixing member is fixed to the mounting plate, the pushing member is located away from the fixing member and resists the polishing belt, the elastic member is connected to the fixing member and capable of pushing the pushing member to move toward the polishing belt.

10. The polishing device of claim 9, wherein the push assembly further comprises a guiding rail and a connecting member, an end of the pushing member opposite to the polishing belt and the mounting plate cooperatively define a pushing space, the guiding rail is mounted on the mounting plate, a first end of the guiding rail is connected to the fixing member, a second end of the guiding rail opposite to the first end is received in the pushing space, the connecting member is slidably mounted on the guiding rail and comprises an extending end and a pushing end at opposite ends thereof, the pushing end is connected to the pushing member, and the extending end is resisted by the elastic member.

11. A polishing device, comprising:

a reducer;

a polishing mechanism connected to the reducer;

a rotatably driven mechanism comprising a first driving member, a transmission shaft and a first cable, wherein the first driving member comprises a first main body and an output shaft rotatably connected to the first main body, the transmission shaft is fixed to the output shaft, the first cable is connected to the first main body; and a sliding driving mechanism comprising a second driving member fixed to the first main body, wherein the second driving member comprises a second cable and defines a through hole thereon, the transmission shaft extends through the through hole of the second driving member and is connected to the reducer to enable the polishing mechanism to polish a workpiece, the second driving member is fixed to the reducer to enable the reducer and the polishing mechanism to rotate completely along a periphery of the workpiece and to polish the workpiece automatically.

12. The polishing device of claim 11, wherein the rotatably driven mechanism further comprises a transmission member, the transmission member is sleeved on the transmission shaft and the output shaft of the first driving member to connect the transmission shaft to the output shaft.

13. The polishing device of claim 12, wherein the second driving member further comprises a second main body and a driving shaft collar rotatably connected to the second main body, the second main body is fixed to the first main body, the driving shaft is fixed to the reducer, the through hole is defined on the second main body and the driving shaft collar, the second main body and the driving shaft further define a pair of receiving portions at opposite ends of the through hole, the sliding driving mechanism further comprises a pair of bearings, the pair of bearings is sleeved on opposite ends of the transmission shaft and received in the pair of receiving portions respectively.

14. The polishing device of claim 13, wherein the transmission shaft comprises a pair of shaft ends at opposite ends thereof, the pair of shaft ends is connected to the reducer and the transmission member respectively, the transmission shaft further comprises a resist portion on the shaft end adjacent to the reducer, and one of the pair of bearings resists the resist portion from an inner side of the transmission shaft.

15. The polishing device of claim 11, further comprising a fixing mechanism, wherein the fixing mechanism comprises a fixing seat, a fixing plate and a mounting seat, the fixing plate is fixed to the fixing seat and defines a through hole thereon, the mounting seat is partially received in the through hole of the fixing plate, and the first main body is fixed to the mounting seat.

16. The polishing device of claim 15, wherein the fixing seat comprises a base body and a clamping portion extending from a middle portion of the base body, the clamping portion comprises a pair of clamping cantilevers and defines a mounting space between the pair of clamping cantilevers, the second driving member is received in the mounting space and located between the pair of clamping cantilevers.

17. The polishing device of claim 15, wherein the polishing mechanism comprises a driving pulley, a tension pulley, a transmission pulley, a polishing belt and a push assembly, the driving pulley is connected to the transmission shaft via the reducer, the polishing belt is sleeved on a periphery of the driving pulley, the tension pulley and the transmission pulley, the push assembly is capable of pushing the polishing belt outward to polish a workpiece.

18. The polishing device of claim 17, wherein the push assembly comprises a fixing member, a pushing member and an elastic member, the fixing member is fixed to the mounting plate, the pushing member is located away from the fixing member and resists the polishing belt, the elastic member is connected to the fixing member and capable of pushing the pushing member to move toward the polishing belt.

19. The polishing device of claim 18, wherein the push assembly further comprises a guiding rail and a connecting member, an end of the pushing member opposite to the polishing belt and the mounting plate cooperatively define a pushing space, the guiding rail is mounted on the mounting plate, a first end of the guiding rail is connected to the fixing member, a second end of the guiding rail opposite to the first end is received in the pushing space, the connecting member is slidably mounted on the guiding rail and comprises an extending end and a pushing end at opposite ends thereof, the pushing end is connected to the pushing member, and the extending end is resisted by the elastic member.

* * * * *